United States Patent [19]

Oerthel

[11] 4,028,752

[45] June 14, 1977

[54] LOAD-CARRYING APPARATUS

[76] Inventor: Hermann Oerthel, Bavariaring 35, D-8000 Munich, Germany

[22] Filed: Sept. 11, 1975

[21] Appl. No.: 612,586

[30] Foreign Application Priority Data

Sept. 25, 1974 Germany ..... 2445764

[52] U.S. Cl. ..... 5/81 R; 5/86

[51] Int. Cl.[2] ..... A61G 7/10; A61G 1/02

[58] Field of Search ..... 5/81, 83, 86, 87, 89; 254/7

[56] References Cited

UNITED STATES PATENTS

| | | | |
|---|---|---|---|
| 1,399,351 | 12/1921 | Lee | 5/86 |
| 2,234,483 | 3/1941 | Sutton | 5/89 |
| 2,679,890 | 6/1954 | Zannoth | 5/86 |
| 3,469,269 | 9/1969 | Brown | 5/86 |
| 3,623,169 | 11/1971 | James | 5/86 |

*Primary Examiner*—Casmir A. Nunberg
*Attorney, Agent, or Firm*—Michael J. Striker

[57] ABSTRACT

An apparatus for lifting, arranging and/or transporting non-ambulatory patients includes a mobile support and an elongated element mounted thereon. The element has three freedoms of movement relative to the support; that is, the element can be raised and lowered in a generally vertical direction, the element can be tilted about an axis extending in the direction of the elongation of the element, and the element can be inclined about an axis extending transversely of the direction of the elongation of the element. The composite movements facilitate the carrying of a patient.

8 Claims, 2 Drawing Figures

LOAD-CARRYING APPARATUS

BACKGROUND OF THE INVENTION

The present invention relates to a load-carrying apparatus and, more particularly to an apparatus which lifts, arranges and/or transports non-ambulatory patients.

It is known in the prior art to lift and rearrange a non-ambulatory patient lying in a hospital bed by using a mobile frame which can pushed about from place to place and which supports a stretcher which can be raised or lowered. In order to use this prior art apparatus, the frame must be brought up to a desired height, and then it must be pushed underneath the patient. This apparatus has the disadvantage that it can only be partially pushed underneath the patient, and that the patient himself must assist the operator by changing his position on the bed and, in effect, the patient must "jump" onto and off the stretcher. This leads to obvious difficulties since the frame is not stationary due to the presence of rollers, and the operator is not free to assist the patient since he is required to hold the frame stationary.

It is also known in the art to use an elongated supporting beam which is adapted to be raised or lowered. The supporting beam has a carrying disc which is arcuately curved in cross-section and a cloth sheet, both of which must be pushed simultaneously underneath a patient. Thus, by gripping the free end of the cloth sheet, a patient can be rolled onto the carrying disc. This apparatus has the obvious drawback that it is most annoying to a patient and is, moreover, very expensive to build.

It is also known in the prior art to use a stretcher which is adapted to be tilted about its longitudinal axis and raised and lowered in the perpendicular vertical direction. However, this stretcher has the drawback that it must be pushed transversely in the horizontal direction underneath a patient. This causes great discomfort to a patient to be lifted, and the apparatus is very costly to manufacture.

SUMMARY OF THE INVENTION

Accordingly, it is the general object of the present invention to overcome the disadvantages of the prior art.

More particularly, it is an object of the present invention to provide an apparatus for carrying loads, particularly non-ambulatory patients, to be lifted, rearranged and/or transported about.

Another object of the present invention is to lift, arrange, and/or transport a patient without causing excessive discomfort to the patient.

A further object of the present invention is to provide an apparatus which is economical and simple to manufacture.

An additional object of the present invention is to lift and arrange a patient without requiring more than one operator to operate the apparatus.

Still another object of the invention is to lift, arrange and/or transport a patient without requiring the active assistance of the patient himself.

In keeping with these objects and others which will become apparent hereinafter, one feature of the load-carrying apparatus is embodied in the mounting of an elongated element onto a support. Combined means are provided for raising and lowering the element relative to the support in a generally vertical direction and for tilting the element relative to the support about an axis extending in the direction of the elongation of the element. The composite movements of the combined means cause the element to facilitate the lifting, arranging and/or transporting of a load, and particularly a non-ambulatory patient.

The freature of tilting or rotating the element about an axis which extends in the direction of the elongation of the element overcomes the aforementioned drawbacks of the prior art and achieves the above-cited objectives in a novel manner. The combined means is simultaneously or alternately independently operable so that an operator can guide the element underneath a patient and simply lift, arrange and/or transport him. The two separate movements taught by the prior art are no longer necessary since the tilting action of the combined means permits the element to approach the patient in a more efficient and simpler manner. Discomfort to the patient is thus aleviated, only one operator is needed to run the apparatus, and the active assistance of the patient himself is no longer necessary.

Another feature of the invention is to provide a third freedom of movement by providing means for inclining the element about an axis which extends in a direction transverse of the elongation of the element. The inclining means includes an axle which is located at the longitudinal center of the element, that is at its center of gravity, so that the element can be rotated in both the clockwise and counterclockwise directions.

This latter feature permits one to approach the head and/or feet region of a patient, rather than laterally at his side regions, as taught by the prior art. This feature is especially useful in narrow hospital rooms where space laterally of the bed is not available.

Still another feature of the present invention is to provide means for arresting the element so that it will maintain a position substantially parallel to the ground upon which the support is movable. This feature assures that an unconscious or non-ambulatory patient will not roll off the element and injure himself during transport.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

DESCRIPTION OF THE PREFERRED EMBODIMENTS

Figure 1:
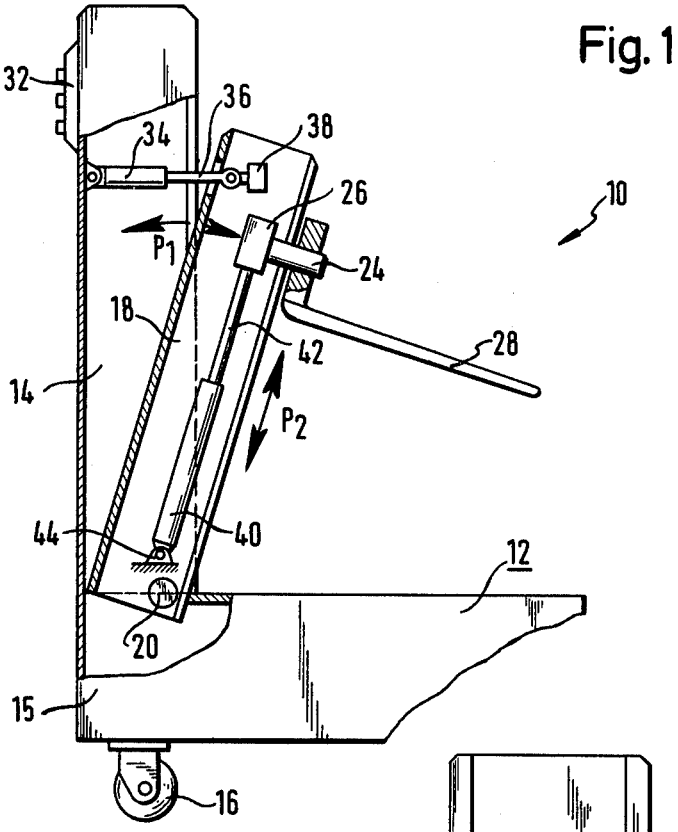
FIG. 1 is a partially-broken, partially-sectioned side view of an apparatus according to the present invention.
Figure 2:
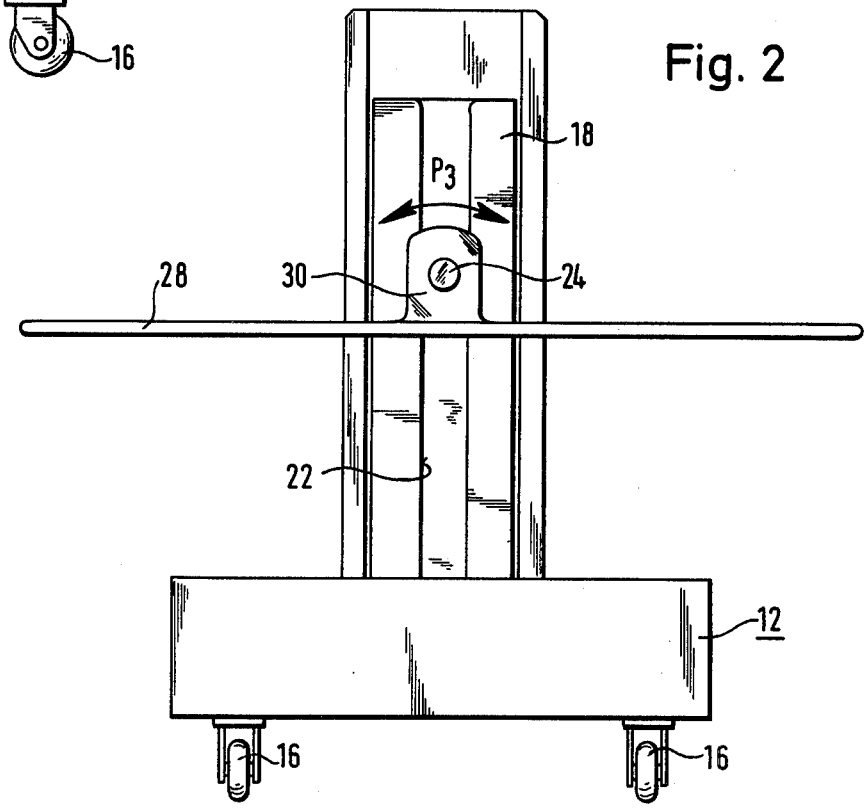
FIG. 2 is a front view of the apparatus illustrated in FIG. 1.

Referring to the preferred embodiment of the invention illustrated in FIGS. 1 and 2, it will be seen that reference numeral 10 identifies the entire load-carrying apparatus in toto. Although the apparatus will be described in connection with the lifting, arranging and/or transport of people, and particularly non-ambulatory patients, it should be understood that the invention is not intended to be limited thereby and can, in fact, be used for moving any load.

A mobile wagon or support 12 is generally L-shaped and has a horizontal base portion 15 and a vertical portion 14 which is securely mounted to the base portion 15 in a transition region by using screws or welding techniques. The support 12 is equipped with wheels 16 so that an operator can push or pull the support 12 about in order to transport a patient from one place to another.

The base portion 15 can be welded out of structural steel or like materials, or assembled by using box beams or girders, or cast with aluminum or similar metals. The vertical portion is preferably made of a box beam which is open at one side, or which can be assembled out of two U-beams which face each other on opposite sides so that they can be connected with each other.

A load-carrying element or shelf 28 is mounted on the support 12 and is elongated, as shown in FIG. 2, from right to left. As will be explained herein, combined means are utilized to raise and lower the element 28 relative to the support 12 in a generally vertical direction and to tilt element 28 relative to the support 12 about an axis or axle 20 which extends in the direction of the elongation of the element 28. It is this combined or composite movement which is used to facilitate the lifting, arranging, and/or transport of a patient.

A supporting member 18 is mounted on the support 12 so that it can move into and out of the interior of the vertical portion 14. As shown in FIG. 2, the supporting member 18 has access by means of an open side of the vertical portion 14. In FIG. 1 the member 18 is shown extending through this open side in a forward direction towards the right. The member 18 can be likewise assembled by using box beams or by connecting two angular sections with each other.

At a first lower end region (near axle 20) of the elongated supporting member 18, the member 18 is pivotally mounted to the support 12 at the longitudinal axle 20 which has an axis which extends in the direction of the elongation of the element 28, that is into the plane of the drawing. The longitudinal axle 20 is illustrated as being located in the transition region between the vertical and base portions, although the position of the axle 20 is not intended to be limited thereby. The second opposite upper end region of the member 18 has a lug or connector 38 which is fastened to the piston 36 of the moving means 34. The moving means 34 has an end which is pivotally connected to the vertical portion 14.

When actuated, the moving means 34 moves the member 18 from its normal vertical position forwardly or clockwise, and then counterclockwise as desired, as diagrammatically illustrated by the curved two-headed arrow P1. I have found that, in most applications, the maximum value of tilting angle needed is at least 10°and at most 20°, and preferably 15°, as measured with respect to the vertical.

The supporting member 18 has a longitudinal slit 22 which extends along a side thereof. A projection or cross-axle 24 having an axis which extends in a direction transverse of the elongation of the element 28 projects through the slit 22 and is connected to the element 28 by means of the connecting piece or lug 30.

The projection 24 can extend over a longer distance than that illustrated in the drawing, that is, it may extend, either partially or completely, across the width of the element 28. In the latter case, the element 28 would be adapted to be placed on top of the projection 24 so as to be supported from below. Alternatively, a frame connected with the projection 24 can be provided to support the element 28.

In the interior of the supporting member 18, moving means 40 has one end pivotally connected at the pivot point 44 which is fixed on the member 18. A piston 42 is connected to the holder 26 which is connected, in turn, to the projection 24.

When actuated, the projection 24 will travel in the slit 22, and the moving means 40 moves the element 28 in a generally up-and-down vertical direction, as diagrammatically illustrated by the two-headed arrow P2. It will be apparent that the moving means 40 will move the element 28 in a direction perpendicular to the ground plane upon which the support travels when the member 18 is vertical, and that the moving means 40 will move the element 28 in a direction substantially perpendicular to the plane of the element 28 when the member is tilted to any one of the previously described tilting angles.

The combined raising, lowering and tilting movements of the apparatus is believed to be already clear from the above description. The raising and lowering means (movement in direction P2) may be either independently or simultaneously operated with the tilting means (movement in direction P1). I found it especially preferable to alternate the actuation of these two movements so as to incrementally lift and arrange a patient to be moved.

A third moving means, which has not been illustrated for the purposes of clarity, is provided in the supporting member 18 either near or inside the holder 26 in order to incline the element 28 about the axle 24. In FIG. 2, this rotary movement is diagrammatically shown by the two-headed arrow P3.

By operation of this inclining means, the axle 24 rotates the element 28 either in the clockwise or counterclockwise direction. I have found that, in most applications, the maximum value of inclination angle in each direction is at least 10° and at most 15°. This additional movement allows an operator to lift a patient by approaching him at his feet or head regions, rather than laterally at his side regions. Moreover, this additional third movement improves the capability and maneuverability in lifting the patient.

The moving means 34, 40 and the non-illustrated moving means provided near or in the holder 26 are all preferably hydraulically-actuated cylinders. However, this choice is not intended to exclude other manual and/or mechanical and/or electrical devices which can also be utilized.

The actuating means for the moving means is located in the interior of the support 12 and preferably within the base portion 15. Thus, depending upon the type of moving means selected, motors, pumps, valves, batteries, electric circuitry and like drive means can be operated at the keyboard 32, which is located on the vertical portion 14 within easy reach of an operator.

Arresting means are utilized to stop the member 18 and the element 28 in their normal load-carrying position, that is, the member 18 is locked in a vertical position and the element 28 is locked in a horizontal position parallel to the ground. These locking devices assure that a patient cannot roll off a tilted element 28 and injure himself.

For ease in transport purposes, two of the wheels 16 can be locked in a straight-ahead position so as to simplify maneuverability for the operator. The height of all the wheels 16 and of the base portion 15 is chosen so that the base portion 15 can be pushed under the bed of a patient. If desired, the apparatus can be provided with self-propelling means whereby motorized means are connected to the wheels 16 and are energized by an internal battery or through AC power supplied through a cable which is continuously paid out by a reel.

The apparatus therefore can be wheeled over to a bed of a patient. By a series of alternate steps, the combined means (P1, P2) and/or the inclining means (P3) can be energized so as to lower and slide the element 28 into position underneath the patient. Thus, by raising the element 28, the patient will be lifted from the bed. In order to lower the patient from the apparatus to the bed, the above-recited steps are to be followed in reverse order.

It will be understood that each of the elements described above, or two or more together, may also find a useful application in other types of a load-carrying apparatus differing from the types described above.

While the invention has been illustrated and described as embodied in a construction, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A load carrying apparatus, particularly for non-ambulatory patients, comprising a support; an elongated load-carrying shelf; a normally upright elongated supporting member having a longitudinal slit extending along a side thereof and also having a lower end region mounted on said support for pivoting about a substantially horizontal axis which extends lengthwise of said shelf, said shelf being mounted on said supporting member upwardly of said lower end region; means for tilting said supporting member about said axis between vertical and inclined positions so as to impart to said shelf a composite movement having one component in generally vertical direction and another component in generally horizontal direction, whereby to facilitate transfer of a load onto and off said shelf; and moving means for raising and lowering said shelf and having one end connected to said sheld and provided with a projecting which extends through said slit in a direction transversely of the elongation of said sheld, said moving means having another end pivotally connected to said lower end region of said shelf.

2. An apparatus as defined in claim 1, wherein said support includes a mobile base portion and a vertical portion mounted on said base portion, and wherein said lower end region is located in the area where said vertical portion is mounted on said base portion.

3. An apparatus as defined in claim 1 and further comprising means for inclining said shelf about an axis of said projection relative to said support.

4. An apparatus as defined in claim 3, wherein said shelf has a center of gravity intermediate its opposite ends, and said projection is connected to said center of gravity; and wherein said tilting means inclines said shelf in both the clockwise and counterclockwise directions.

5. An apparatus as defined in claim 2; and further comprising means for arresting said shelf in a position in which said supporting member extends substantially vertical and said shelf extends substantially parallel relative to the ground upon which said support is movable.

6. An apparatus as defined in claim 1, wherein said means tilts said shelf about said axis through a tilting angle of at least 10° and at most 20°.

7. An apparatus as defined in claim 6, wherein said tilting angle is at least 15°.

8. An apparatus as defined in claim 3, wherein said means inclines said shelf about said transverse axis through an inclination angle of at least 10° and at most 15°

* * * * *